US010662701B1

(12) United States Patent
Penner

(10) Patent No.: US 10,662,701 B1
(45) Date of Patent: May 26, 2020

(54) APPARATUS FOR BRACING A FENCE GATE AND METHODS OF MAKING AND USING SAME

(71) Applicant: Levi Penner, Oklahoma City, OK (US)

(72) Inventor: Levi Penner, Oklahoma City, OK (US)

( * ) Notice: Subject to any disclaimer, the term of this patent is extended or adjusted under 35 U.S.C. 154(b) by 315 days.

(21) Appl. No.: 15/405,057

(22) Filed: Jan. 12, 2017

Related U.S. Application Data

(60) Provisional application No. 62/278,253, filed on Jan. 13, 2016.

(51) Int. Cl.

| | |
|---|---|
| ***E06B 11/02*** | (2006.01) |
| ***E06B 5/10*** | (2006.01) |
| ***E04H 17/16*** | (2006.01) |
| ***E06B 7/28*** | (2006.01) |

(52) U.S. Cl.
CPC ..... *E06B 5/10* (2013.01); *E04H 17/168* (2013.01); *E06B 7/28* (2013.01); *E06B 11/02* (2013.01)

(58) Field of Classification Search
CPC ..... E06B 11/02; E06B 11/023; E06B 11/026
USPC ..... 256/31, 73
See application file for complete search history.

(56) References Cited

U.S. PATENT DOCUMENTS 645,842 A * 3/1900 Tennant ..... E06B 11/02 256/73
1,232,609 A * 7/1917 Rowe ..... E06B 11/02 256/73
1,298,072 A * 3/1919 McNabbey et al. .... E06B 11/02 256/73
1,394,479 A * 10/1921 Ewald ..... E06B 11/02 256/73
1,449,587 A * 3/1923 Colvin ..... E06B 11/02 256/73
1,455,356 A * 5/1923 Rolfe ..... E06B 11/02 160/157
2,500,236 A * 3/1950 Anderson ..... E06B 11/02 49/247
3,740,897 A * 6/1973 Johns ..... E06B 11/02 256/37
4,682,761 A * 7/1987 Hanneken ..... E04H 17/22 256/36
4,793,098 A * 12/1988 Wilkerson ..... E05B 53/003 49/381
5,716,041 A * 2/1998 Groves ..... E06B 11/02 256/24
5,868,382 A * 2/1999 Groves ..... E06B 11/02 256/24
5,899,171 A * 5/1999 Abrahamson ..... A01K 3/00 119/512
6,446,938 B1 * 9/2002 Hadfield, Sr. ..... E06B 11/02 256/19

(Continued)

FOREIGN PATENT DOCUMENTS

GB 811493 A * 4/1959 ..... E06B 11/02

*Primary Examiner* — Jonathan P Masinick
(74) *Attorney, Agent, or Firm* — Hall Estill Law Firm

(57) ABSTRACT

An apparatus for bracing a fence gate during installation of the fence gate. The apparatus includes at least one support member and a brace bar. The at least one support member is mounted to the fence gate. The brace bar has a first end, a second end and a brace portion extending therebetween. A first portion of the brace bar is connectable to the fence gate and a second portion of the brace bar is adjustably connectable to the at least one support member.

5 Claims, 5 Drawing Sheets

(56) References Cited

U.S. PATENT DOCUMENTS

| | | | | |
|---|---|---|---|---|
| 6,751,906 | B2 * | 6/2004 | Bass | E06B 11/02 256/24 |
| 6,938,882 | B2 * | 9/2005 | Hadfield, Sr. | E06B 11/02 256/65.01 |
| 8,596,619 | B2 * | 12/2013 | Volin | E04H 17/163 256/73 |
| 9,512,674 | B2 * | 12/2016 | Keudell | E06B 11/022 |

* cited by examiner

APPARATUS FOR BRACING A FENCE GATE AND METHODS OF MAKING AND USING SAME

CROSS-REFERENCE TO RELATED APPLICATIONS/INCORPORATION BY REFERENCE STATEMENT

The present patent application claims priority to United States Provisional Patent Application U.S. Ser. No. 62/278,253, filed on Jan. 13, 2016, the entire contents of which is hereby expressly incorporated herein by reference.

FIELD OF THE INVENTION

The present disclosure relates generally to fence gate braces, and more particularly, not by way of limitation, to an improved gate brace assembly for building a fence gate.

BACKGROUND OF THE INVENTION

Various braces are used to provide support during installation when constructing a fence gate for a stockade fence.

To this end, although gate braces of the existing art are operable, further improvements are desirable to enhance the construction of a fence gate. It is to such a gate brace assembly that the present disclosure is directed.

BRIEF DESCRIPTION OF THE DRAWING(S)

DETAILED DESCRIPTION OF THE INVENTION

Figure 1:
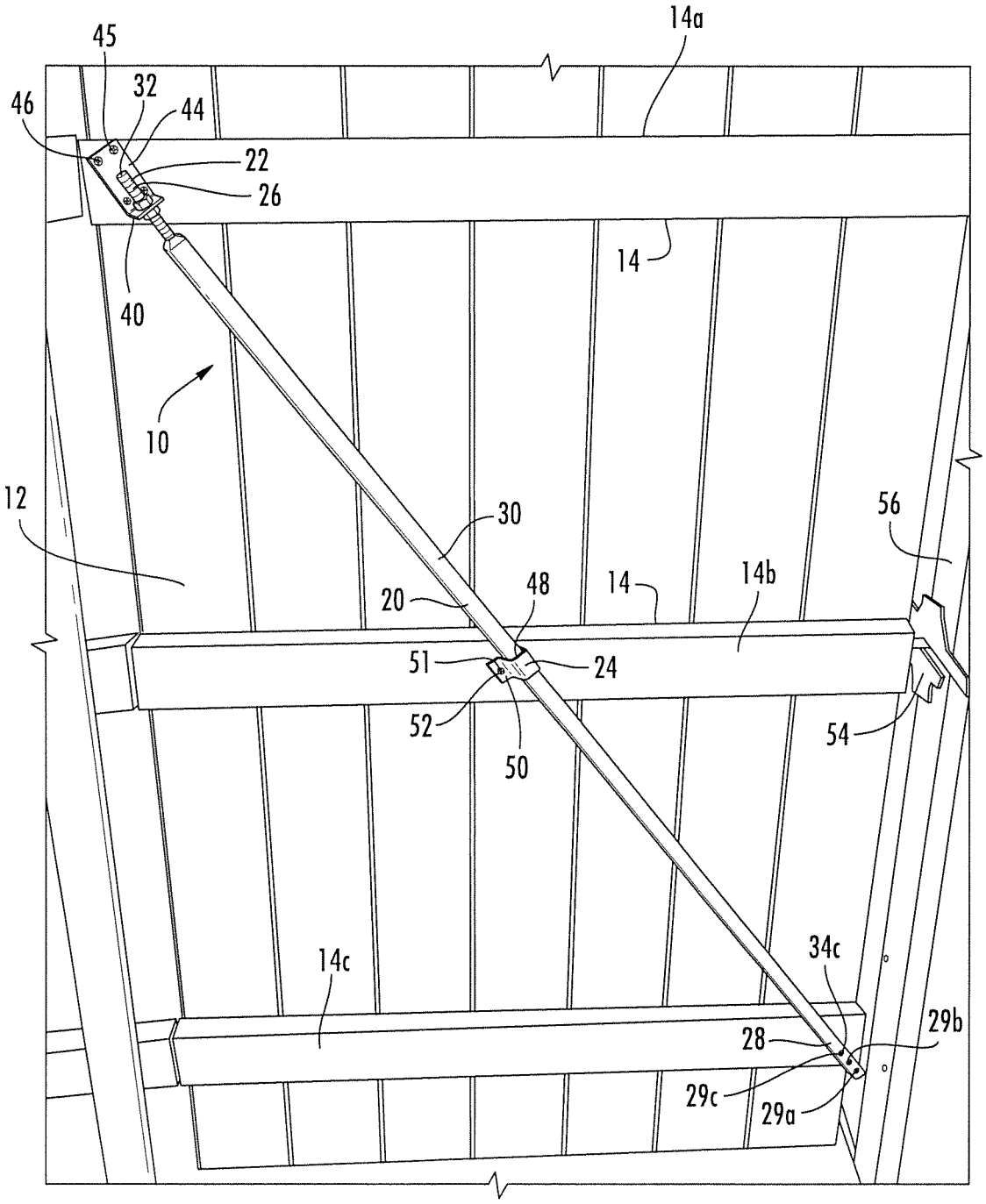
FIG. 1 is a perspective view of one embodiment of a gate brace assembly constructed in accordance with the present disclosure, the gate brace assembly mounted on a fence gate.

Before explaining at least one embodiment of the inventive concept disclosed herein in detail, it is to be understood that the inventive concept is not limited in its application to the details of construction, experiments, exemplary data, and/or the arrangement of the components set forth in the following description, or illustrated in the drawings. The presently disclosed and claimed inventive concept is capable of other embodiments or of being practiced or carried out in various ways. Also, it is to be understood that the phraseology and terminology employed herein is for purpose of description only and should not be regarded as limiting in any way.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
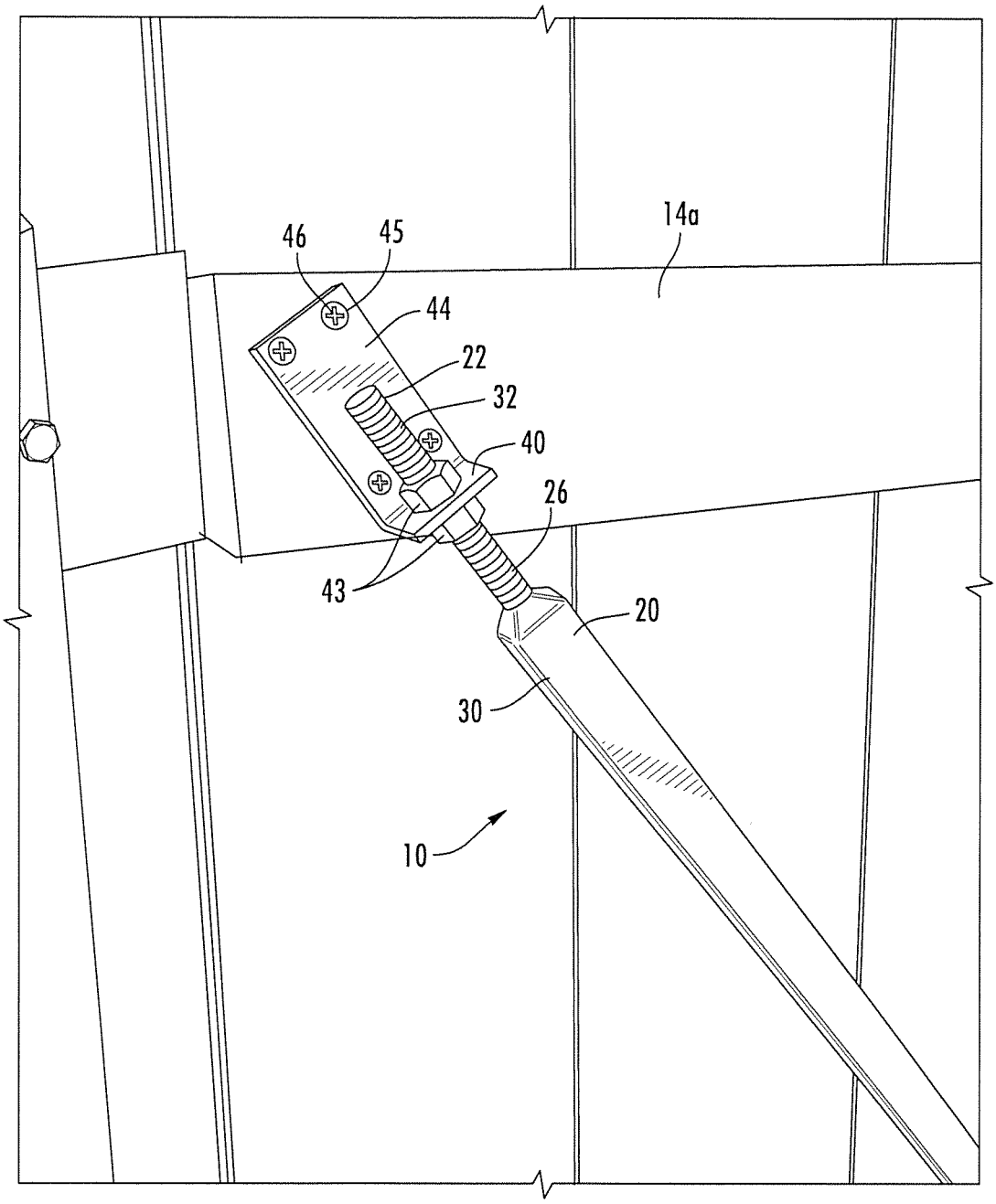
FIG. 2 is a perspective view of a first end of the gate brace assembly of FIG. 1.
Figure 3:
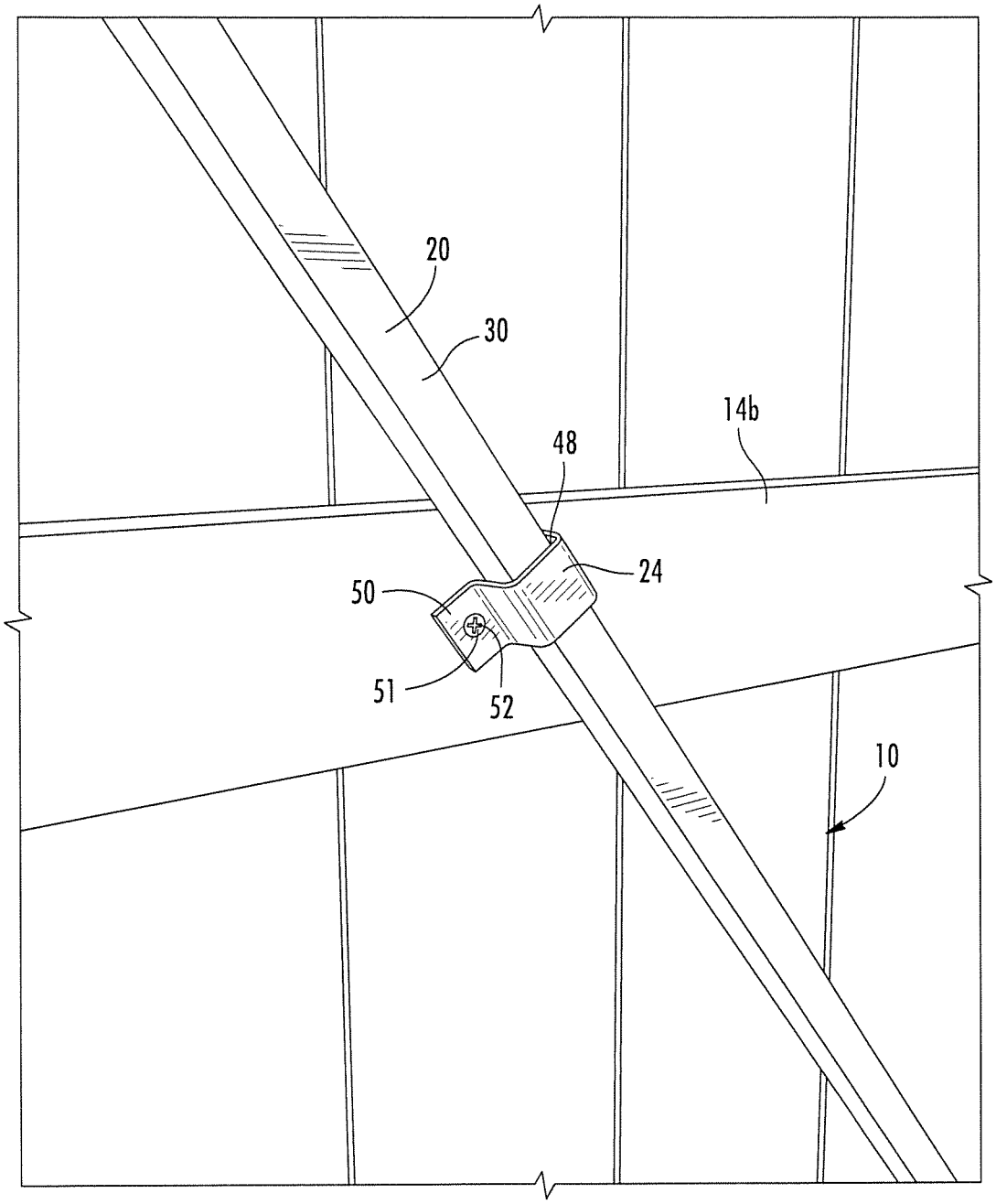
FIG. 3 is a perspective view of a second end of the gate brace assembly of FIG. 1.
Figure 4:
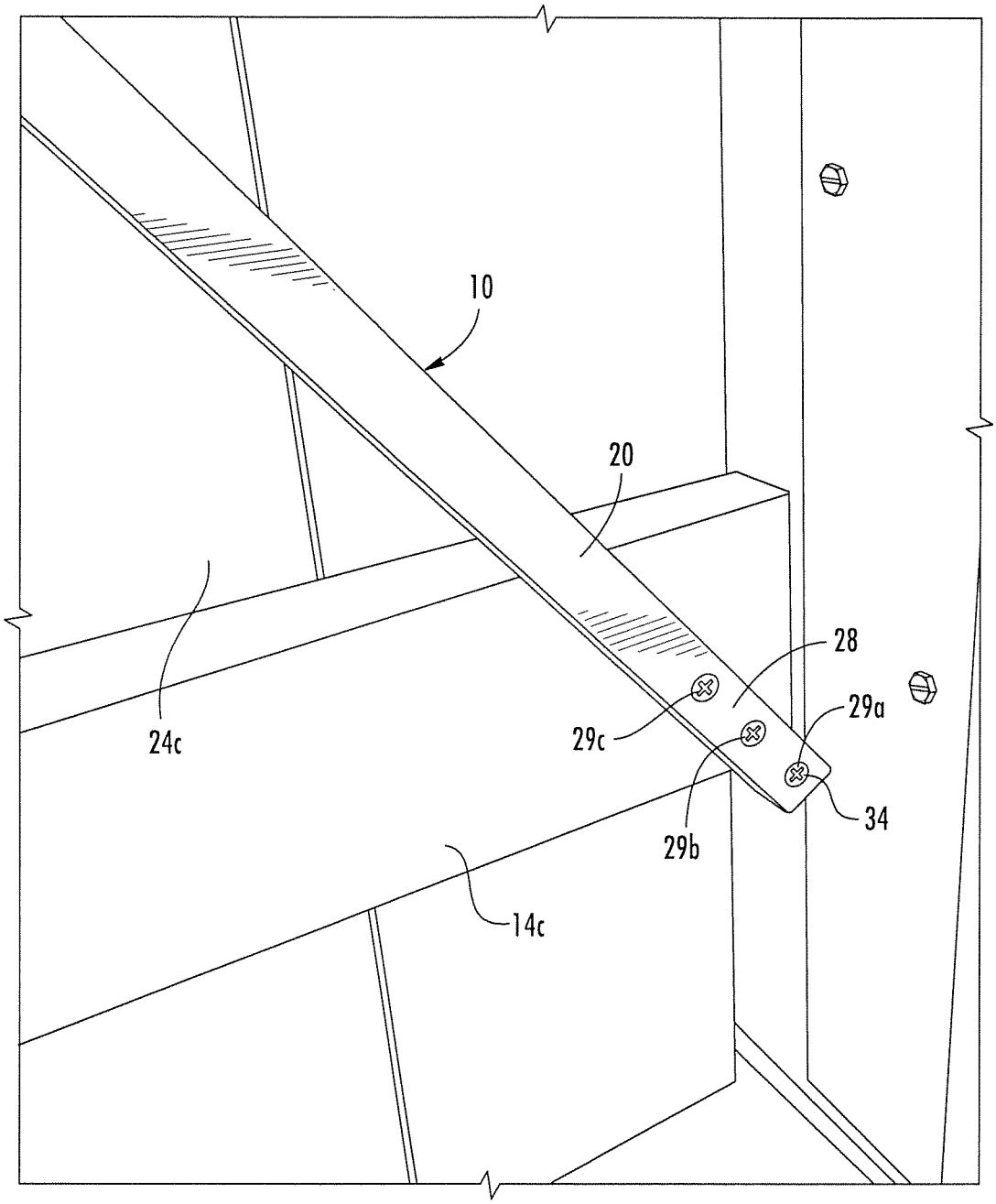
FIG. 4 is a perspective view of a middle portion of the gate brace assembly of FIG. 1.
Figure 5:
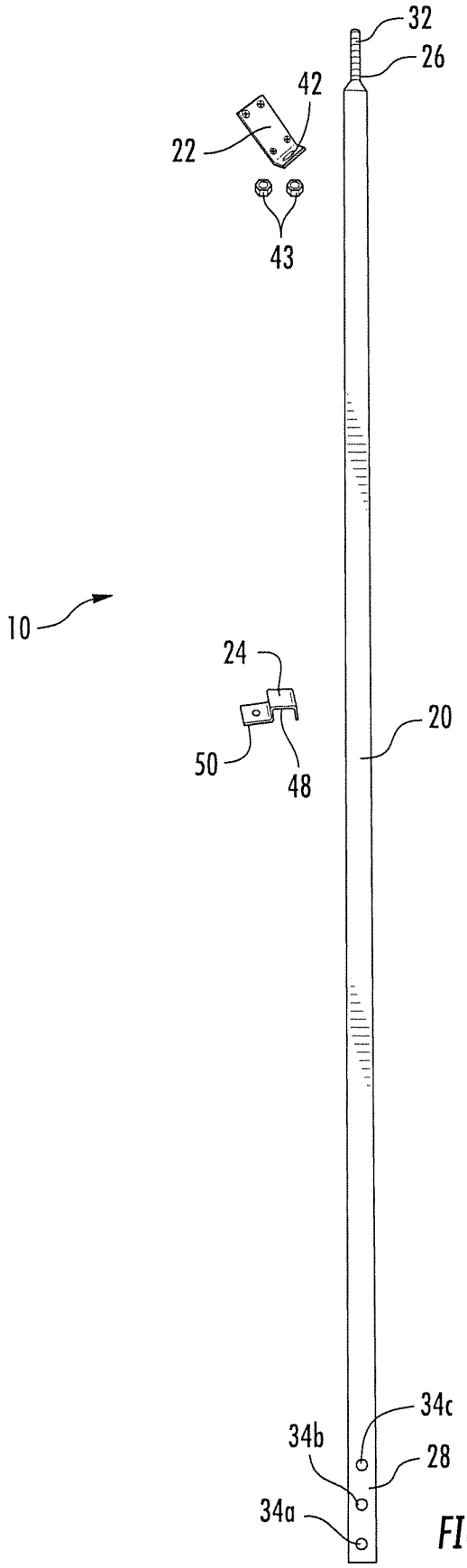
FIG. 5 is a perspective view of a gate brace assembly unassembled.

Referring now to the drawings, and more particularly to FIG. 1-5, shown therein is an exemplary embodiment of a gate brace assembly 10 constructed in accordance with the inventive concepts disclosed herein, the gate brace assembly 10 being shown mounted on a fence gate 12. Typically, the fence gate 12 is a conventional fence gate used with a wood or stockade fence. The fence gate 12 includes a plurality of horizontal supports 14 (an upper support 14*a*, a middle support 14*b*, a lower support 14*c*) and a plurality of vertical members 16 attached to the plurality of horizontal supports 14. It should be understood that though, as shown, the gate brace assembly 10 is utilized with a wood fence, the gate brace assembly 10 may be utilized with any material used to construct a fence gate, such as, for example, metal, vinyl or the like.

It is contemplated that the gate brace assembly 10 is constructed of various components, however, it should be understood that the gate brace assembly 10 may be constructed from one piece of material. The gate brace assembly 10 is preferably made of a durable and rigid material which is strong enough to support the plurality of horizontal supports 14 and the plurality of vertical members 16 of the fence gate 12. Suitable materials for construction of the gate brace assembly 10 and any components thereof include metals such as stainless steel, galvanized steel, aluminum, brass, steel, titanium, magnesium or alloys containing these metals, woods, polymeric materials, plastics, and/or composite materials which are capable of providing the desired strength and durability for the gate brace assembly 10. The gate brace assembly 10 may be rigid, semi-rigid, flexible, semi-flexible, foldable, collapsible, and the like. It should be appreciated that the size and configuration of the gate brace assembly 10, and portions thereof, may vary widely dependent upon the size of the fence gate 12.

The gate brace assembly 10 includes a brace bar 20, a first support member 22 and a second support member 24. The brace bar 20 has a first end 26, a second end 28 and a brace portion 30 extending therebetween. The first end 26 of the brace bar 20 has a threaded portion 32 and the second end 28 of the brace bar 20 has at least one opening 34 (shown in one embodiment as 34*a*, 34*b* and 34*c*) so that the second end 28 is removably connectable to the horizontal support member 14*c* with at least one screw 29 (shown in one embodiment as 29*a*, 29*b* and 29*c*). The brace bar 20 may be sized and configured in a variety of ways necessary to support the plurality of horizontal supports 14 and the plurality of vertical members 16 of the fence gate 12.

A first portion 40 of the first support member 22 has a hole 42 sized to allow slidable insertion of the threaded portion 32 of the first end 26 of the brace bar 20. The threaded portion 32 of the brace bar 20 is secured to the first support member 22 by a pair of nuts 43. Though the threaded portion is shown constructed at one end of the brace bar 20, other embodiments may include a threaded portion at the opposite end, in the center and or at opposing ends of the brace bar 20. Further, although a threaded portion is shown being used to provided adjustability to the gate brace assembly 10, it should be understood by one of ordinary skill in the art that any other such device or method for providing adjustability of the brace bar in relation to a support member as discussed herein may be utilized.

A second portion 44 of the first support member 22 has holes 45 which allows for attachment to the horizontal support member 14*a* with screws 46. In one exemplary embodiment, the first support member 22, is a L-shaped bracket. However, it should be understood that any type of attachment member may be utilized so long as the support/attachment member functions in accordance with the present disclosure as described herein.

The second support member 24 includes a receiving portion 48 and a connecting portion 50. The brace bar 20 is positioned in the receiving portion 48 of the second support member 24 and is supported against the horizontal member 14*b*. The connecting portion 50 is provided with holes 51 for attachment of the second support member 24 to the horizontal support member 14*b* of the fence gate 12 with screws 52. In one exemplary embodiment, the second support member 24 is a u-shaped bracket. However, it should be understood that any type of attachment member may be utilized so long as the support/attachment member functions in accordance with the present disclosure as described herein.

In use, one embodiment of the brace bar 20 is positioned against the fence gate 12. The second end 28 of the brace bar 20 is attached to the horizontal support member 14*c*. Next, the second support member 24 is positioned about a portion of the brace bar 20 and is attached to the horizontal support member 14*b*. Then, the first support member 22 is attached to the horizontal support member 14*a*. The threaded portion 32 of the brace bar 20 (positioned in the hole 42) is slidably moved and adjusted so as to obtain the proper swing, level and height of the fence gate 12 above the ground and so as that a gate latch (not shown) on the fence gate 12 will be positioned at a constant height for engagement with a gate catch 54 on a post 56. When the threaded portion 32 of the brace bar 20 is at the proper adjustment, the threaded portion 32 is secured to the first support member 22 with the nuts 43.

From the above description, it is clear that the inventive concept(s) disclosed herein is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made which will readily suggest themselves to those skilled in the art and which are accomplished without departing from the scope of the inventive concept disclosed herein and defined by the appended claims.

What is claimed is:

1. An apparatus for bracing a wood fence gate during installation or repair of the fence gate, comprising:

a brace bar having a first end, a second end and a brace portion extending therebetween, wherein the first end of the brace bar is provided with a threaded adjustable portion and wherein the second end of the brace bar is removably connected to a planar portion of the fence gate;

at least one support member having a first portion and a second portion wherein the second portion is mounted to the planar portion of the fence gate and the first portion has an opening for receiving the threaded adjustable portion of the brace bar, the first portion of the at least one support member extends outwardly a distance from the second portion of the at least one support member and the planar portion of the fence gate; and at least one securing member positioned about the first end of the brace bar so that the at least one securing member is threadingly adjusted to provide for a proper adjustment of the brace bar on the fence gate.

2. The apparatus of claim 1 wherein the at least one support member is provided with an opening for receiving a portion of the brace bar.

3. An apparatus for bracing a wood fence gate during installation or repair of the fence gate, comprising:

a brace bar having a first end, a second end and a brace portion extending therebetween, wherein a first end of the brace bar is provided with a threaded adjustable portion and wherein the second end of the brace bar is removably connected to a planar portion of the fence gate; and a support member having a first portion and a second portion wherein the second portion is mounted to the planar portion of the fence gate and the first portion extends outwardly a distance from the second portion of the support member and the planar portion of the fence gate wherein the first portion of the support member is configured to threadingly receive the threaded adjustable portion of the brace bar so as to provide for proper adjustment of the brace bar on the fence gate.

4. The apparatus of claim 3 wherein the first support member is provided with an opening for receiving a portion of the brace bar.

5. The apparatus of claim 3 wherein the first support member having a first portion and a second portion wherein the first portion is provided with an opening for receiving the threaded portion of the first end of the brace bar and wherein the second portion is attached to the fence.

* * * * *